United States Patent [19]

Lindtveit

[11] 4,247,267

[45] Jan. 27, 1981

[54] VALVE CONTROLLED REVERSIBLE PUMP

[75] Inventor: Herbert E. Lindtveit, Wheaton, Ill.

[73] Assignee: Sid Harvey, Inc., Valley Stream, N.Y.

[21] Appl. No.: 952,308

[22] Filed: Oct. 18, 1978

[51] Int. Cl.[3] ..... F04C 2/10; F04C 15/02

[52] U.S. Cl. ..... 418/32

[58] Field of Search ..... 418/32, 170; 417/315

[56] References Cited

U.S. PATENT DOCUMENTS

| | | | |
|---|---|---|---|
| 1,595,381 | 8/1926 | Christensen | 418/32 |
| 2,148,561 | 2/1939 | Kempton et al. | 418/32 |
| 2,277,270 | 3/1942 | Schmitter et al. | 418/32 |
| 2,781,726 | 2/1957 | Bangs | 418/32 |
| 3,208,392 | 9/1965 | Garrison et al. | 418/32 |
| 3,960,469 | 6/1976 | Lindtveit | 418/39 |

FOREIGN PATENT DOCUMENTS

| | | | |
|---|---|---|---|
| 493984 | 6/1953 | Canada | 418/32 |
| 522202 | 6/1940 | United Kingdom | 418/32 |
| 835686 | 5/1960 | United Kingdom | 418/32 |

*Primary Examiner*—John J. Vrablik

*Attorney, Agent, or Firm*—Cooper, Dunham, Clark, Griffin & Moran

[57] ABSTRACT

The pump drive shaft may rotate in either direction. The pump discharges liquid from the same port, regardless of the direction of rotation. A port on the pump mounting pad, which receives the discharge from the pump, may be in any of various locations. The pump has plural discharge ports at different locations on its base plate, one of which is aligned with the receiving port on the mounting pad. Any discharge port not used in any particular embodiment is blocked. The pump includes a base plate, a pump plate and a cover plate, aligned in a stack. In one modification, all fluid passages and a valve means which controls the direction of the flow are located in the base plate. In other modifications, a valve plate is provided, and the valve means is located in the valve plate. The fluid passages may be completely in the valve plate or partly in some of the other plates. All valves are simple structures trapped in chambers between or within the plates. Some modifications have noise reduction means, including a tortuous inlet passage and pump gear teeth wide enough to block that passage periodically. One embodiment has a valve which opens easily to a restricted flow position to facilitate purging of air from the pump.

12 Claims, 27 Drawing Figures

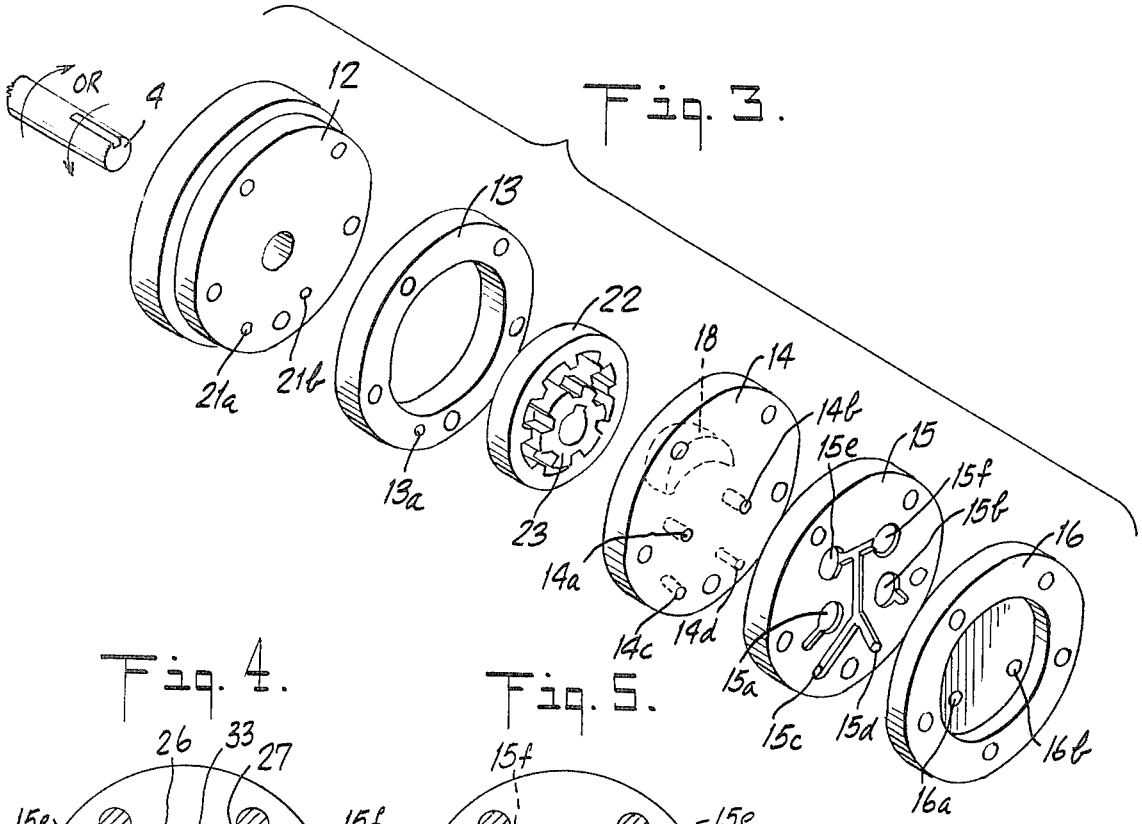
Fig. 3.
Fig. 4.
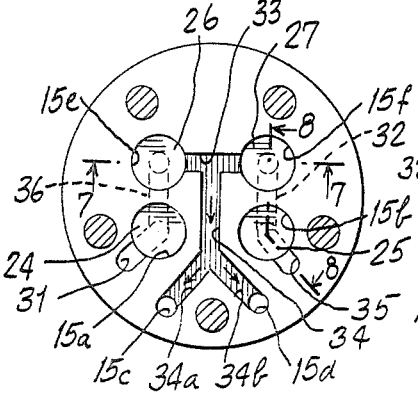
Fig. 5.
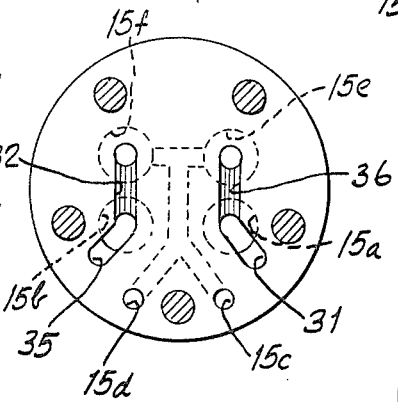
Fig. 6.
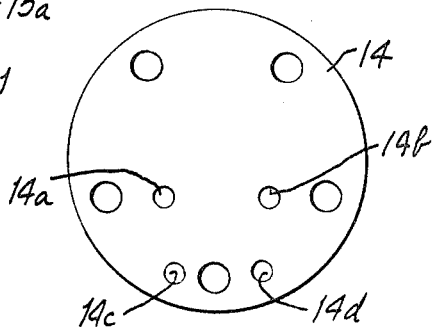
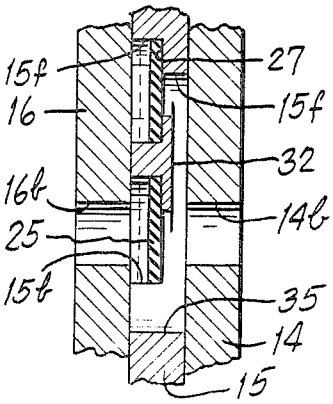
Fig. 8.
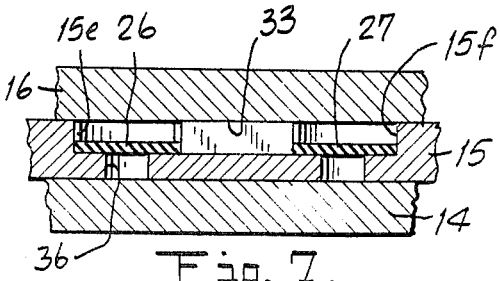
Fig. 7.

Fig. 13.
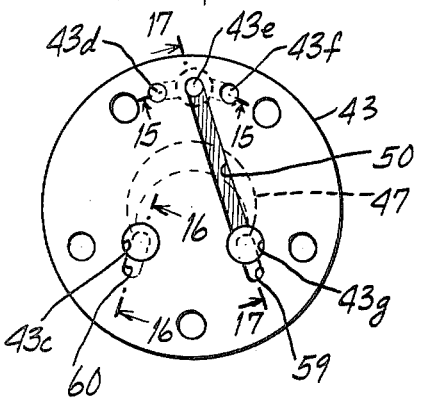
Fig. 14.
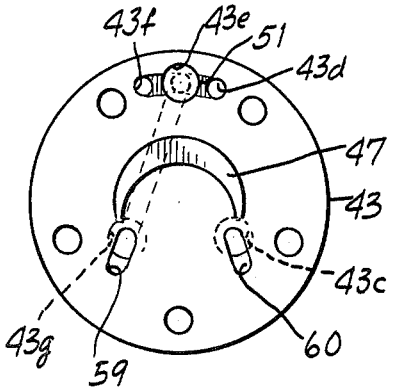
Fig. 15.
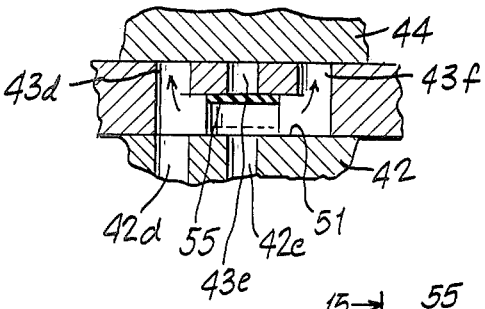
Fig. 16.
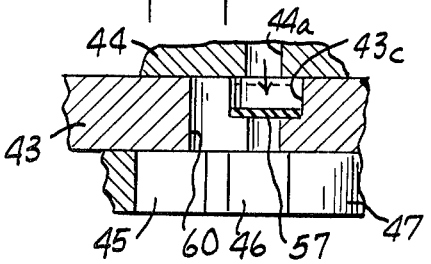
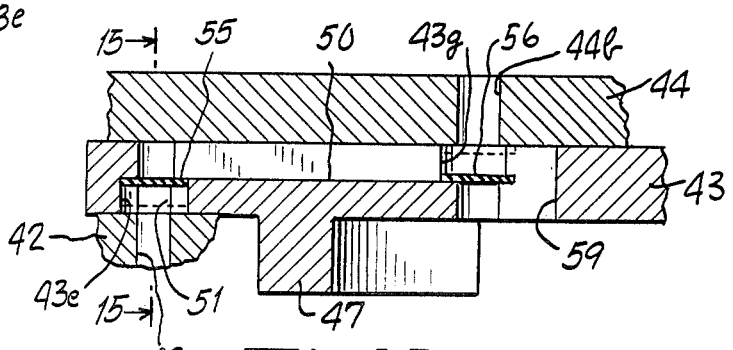
Fig. 17.

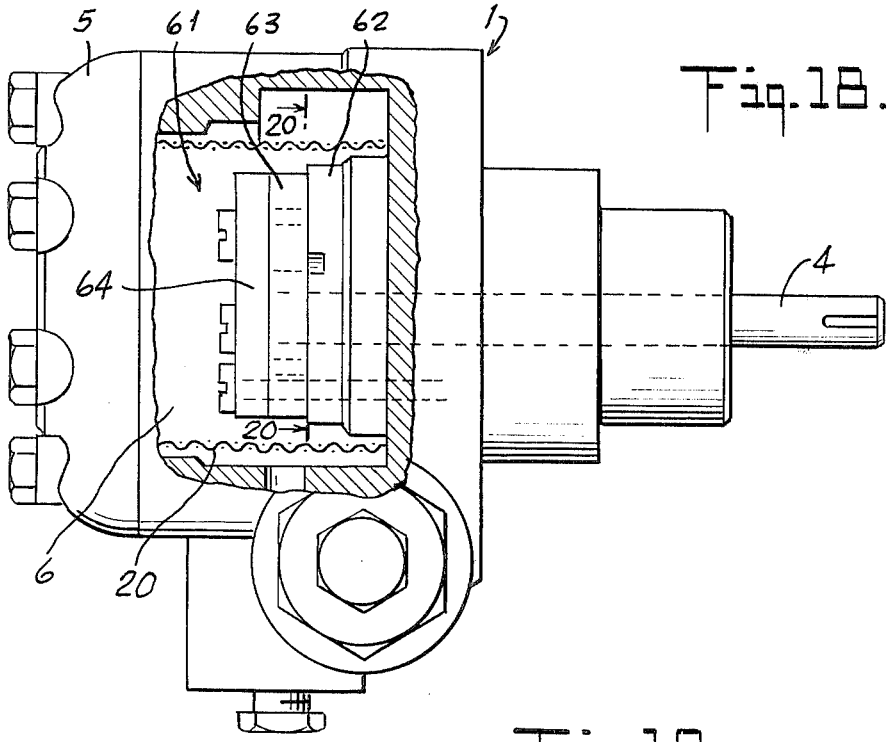
Fig. 18.
Fig. 19.
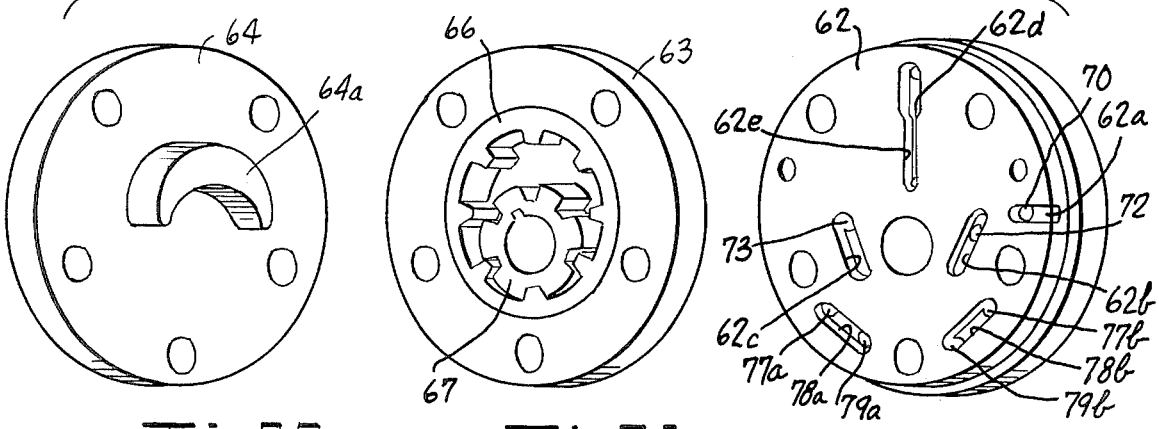
Fig. 20.
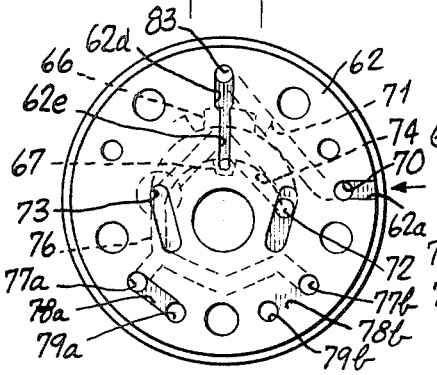
Fig. 21.
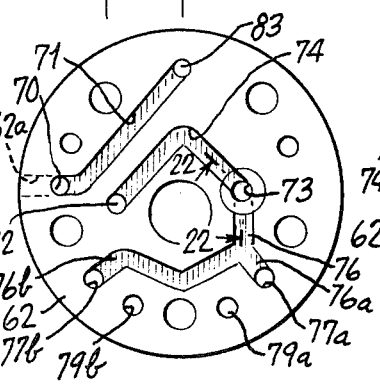
Fig. 22.
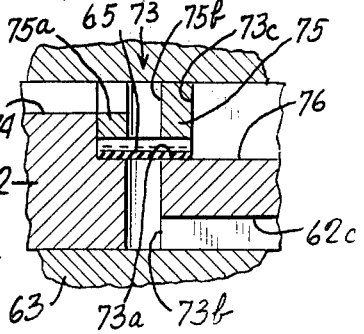

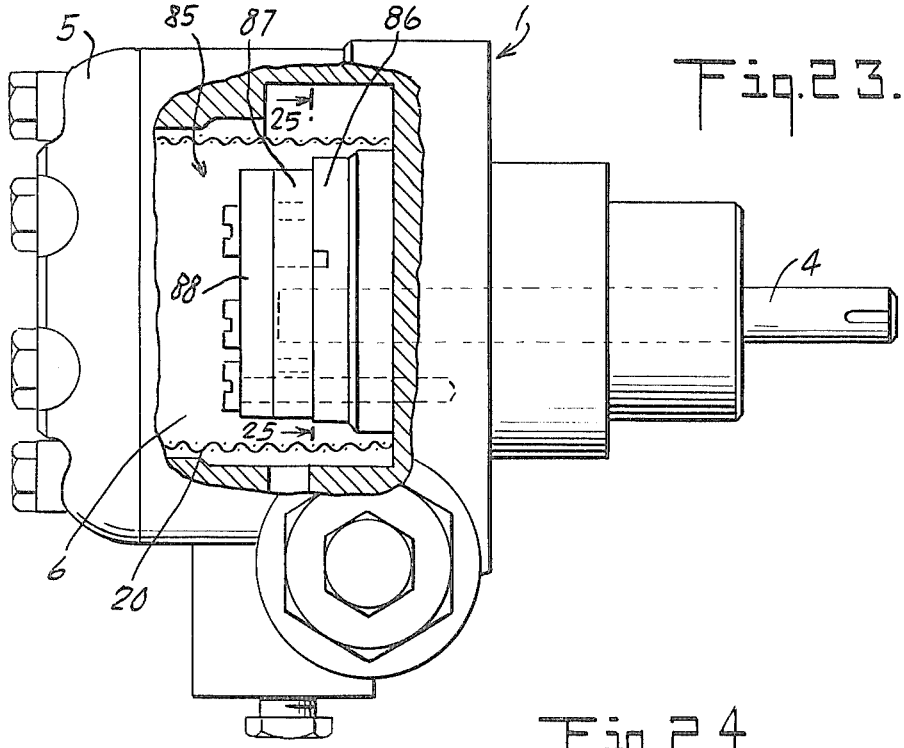
Fig. 23.
Fig. 24.
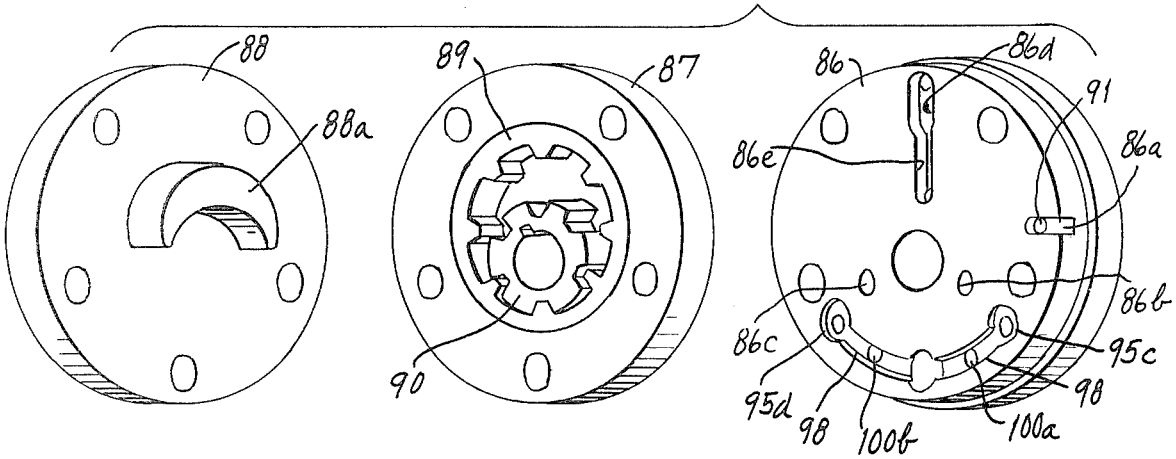
Fig. 25.
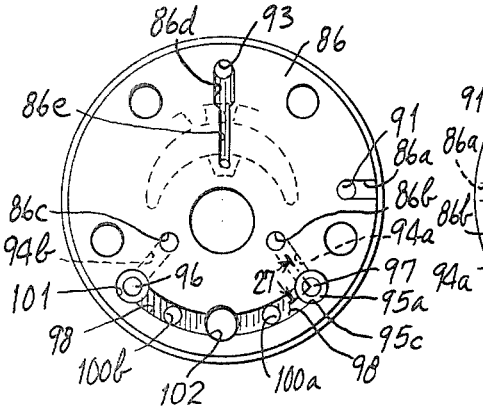
Fig. 26.
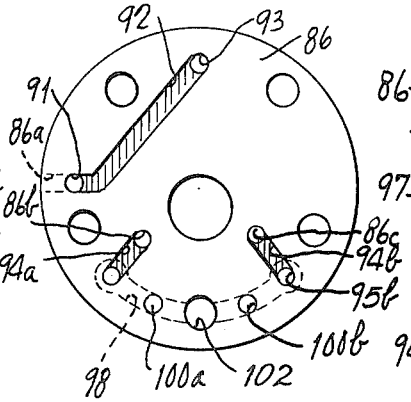
Fig. 27.
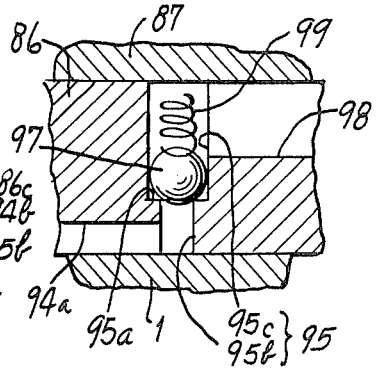

VALVE CONTROLLED REVERSIBLE PUMP

CROSS-REFERENCE

This invention is an improvement on the reversible pump disclosed in my U.S. Pat. No. 3,960,469 issued June 1, 1976.

BRIEF SUMMARY

The pumps described herein are intended as replacements for original equipment, for example, on oil burners. The pump drive shaft on some oil burners rotates clockwise, and on others it rotates counterclockwise. This replacement pump discharges liquid from one discharge port, regardless of the direction of rotation of the drive shaft. Furthermore, the port on the pump housing for receiving liquid from the pump may be located in different positions with respect to the drive shaft on different pump housings. This replacement pump is adaptable to deliver liquid to any of various discharge ports. In any particular pump, the discharge port selected is aligned with the receiving port of the pump housing when the pump is in place on its mounting pad. All other discharge ports are blocked.

The pump structures shown are simple and easy to mount on an oil burner or other device with which it is intended to be used. The pumps are quiet in operation, as is particularly required for use on domestic oil burners.

Pumps of the present invention comprise a base plate which engages the mounting pad of the pump housing, a pump plate which encloses the pump elements and a cover plate. Some modifications also include a valve plate, which encloses a valve mechanism that determines the direction of discharge from the pump. In the modification with no valve plate, the valve mechanism is within the base plate.

In all modifications, the valves are simple discs or balls trapped in chambers and moved by fluid pressure to perform their control functions.

DRAWINGS

FIG. 3 is an exploded perspective view of the principal parts of the pump shown in FIG. 1.

FIG. 4 is a view of a valve plate shown in FIG. 3 and taken on the line 4—4 of FIG. 1.

FIG. 5 is a view of the valve plate of FIG. 4 taken from the opposite side, i.e., on the line 5-5 of FIG. 1.

FIG. 6 is an elevational view of another plate employed in the pump of FIGS. 1-3.

FIG. 7 is a sectional view taken on the line 7—7 of FIG. 4, on an enlarged scale.

FIG. 8 is a view taken on the line 8—8 of FIG. 4, also on an enlarged scale.

FIG. 13 is a view of a valve plate, taken on the line 13—13 of FIG. 9.

FIG. 14 is a view of the valve plate of FIG. 13, taken from the opposite side.

FIG. 15 is a sectional view taken on the line 15—15 of FIG. 13.

FIG. 16 is a sectional view taken on the line 16—16 of FIG. 13.

FIG. 17 is a sectional view taken on the line 17—17 of FIG. 13.

FIG. 18 is a view, partly in elevation and partly in section similar to FIG. 1, showing another modification of the invention.

FIG. 19 is an exploded perspective view of the pump of FIG. 18, with the cover plate reversed.

FIG. 20 is a view taken on the line 20—20 of FIG. 18, showing the base plate.

FIG. 21 is a rear view of the base plate of FIG. 20.

FIG. 22 is a sectional view taken on the line 22—22 of FIG. 21.

FIG. 23 is a view partly in elevation and partly in section, similar to FIG. 1, showing still another modification.

FIG. 24 is an exploded perspective view of the pump of FIG. 23, with the cover plate reversed.

FIG. 25 is a view taken on the line 25—25 of FIG. 23, showing the base plate.

FIG. 26 is a rear view of the base plate of FIG. 25.

FIG. 27 is a sectional view taken on the line 27—27 of FIG. 25.

DETAILED DESCRIPTION

Figure 1:
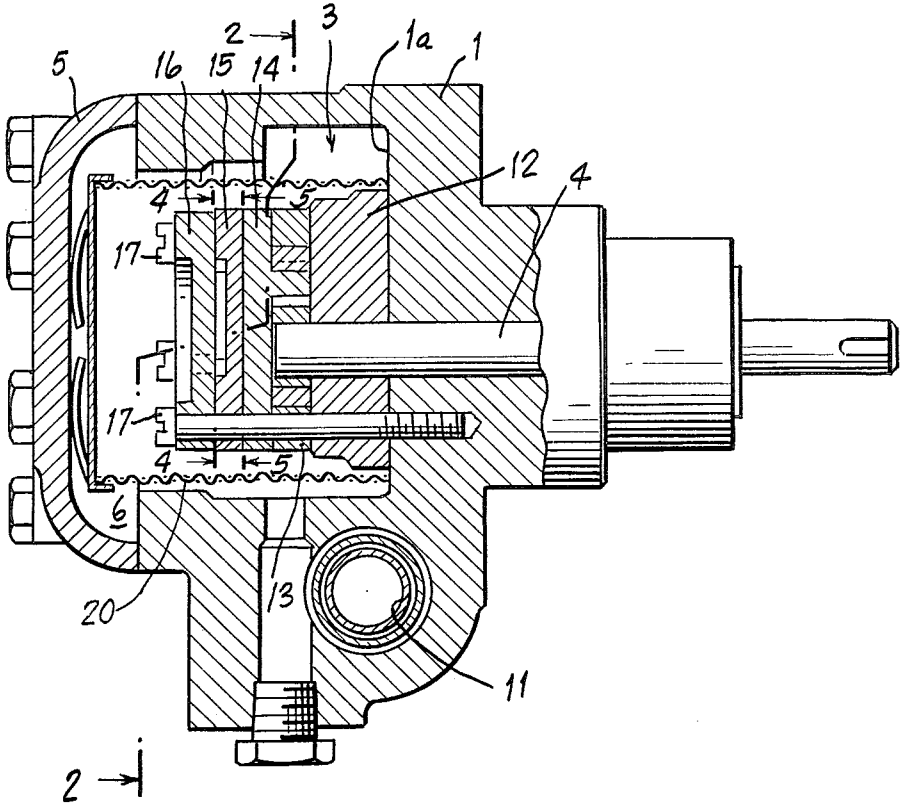
FIG. 1 is a cross-sectional view of a pump assembly embodying the invention, taken on the line 1—1 of FIG. 2.
Figure 2:
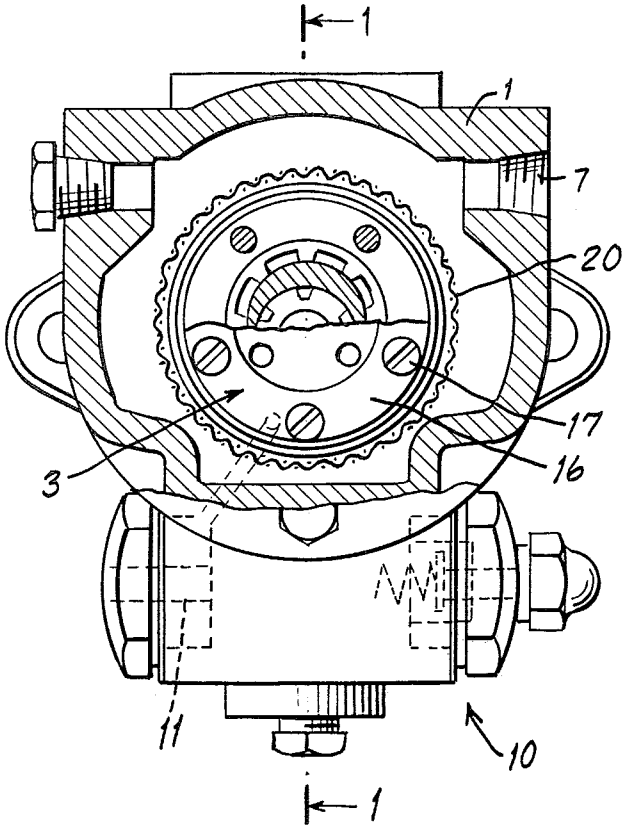
FIG. 2 is a cross-sectional view taken on the line 2—2 of FIG. 1.

FIGS. 1 and 2 show a complete pump assembly including a housing 1 having a mounting pad 1*a* on which a pump generally indicated at 3 is supported. The housing 1 encloses a drive shaft 4 adapted for connection to a motordriven shaft on the oil burner. A cover 5 encloses the end of the housing 1 opposite the drive shaft 4. The housing 1 and the cover 5 enclose a chamber 6 connected to an inlet 7 and normally fill with oil or other liquid to be pumped A pressure regulating valve 10, of conventional construction, is located in another chamber in the housing 1 and delivers the fluid being pumped through a discharge conduit 11 at substantially constant pressure.

The pump assembly 3 includes a base plate 12, a pump plate 13, a crescent plate 14, a valve plate 15 and a cover plate 16. The plates 12, 13, 14, 15 and 16 are stacked and are attached to the mounting pad 1*a* by means of screws 17. A screen 20 of conventional construction encloses the pump assembly. The base plate 12, as shown in FIG. 3, includes five apertures to receive the screws 17, an aperture to receive the shaft 4 and two discharge passages 21*a*, 21*b*, one of which communicates with the discharge line 11 in FIGS. 1 and 2, through a delivery port in the casing 1 (not shown).

The pump plate 13 is an annulus and rotatably encloses a gear pump incluing an internally toothed ring gear 22 cooperating with a pinion 23 fixed on the shaft 4. Either the gear 22 or pinion 23 may be termed a rotor. The crescent plate 14 has fixed on its rear side a crescent 18 which fills the space between the pinion 23 and the ring gear 22. The plate 14 also includes four axially extending passages 14*a*, 14*b*, 14*c* and 14*d*. The valve plate 15 also has four axially extending passages 15*a*, 15*b*, 15*c* and 15*d* aligned with and communicating with the correspondingly lettered passages in the crescent plate 14. Valve plate 15 also includes two additional axial passages 15*e* and 15*f*.

Cover plate 16 has two inlet ports 16*a* and 16*b* which communicate with the correspondingly lettered passages in the valve plate 15. Passages 15*a*, 15*b*, 15*e* and 15*f* in the valve plate 15 are enlarged at their ends adjacent the plate 16 to form valve chambers. Four valve discs 24, 25, 26 and 27 are trapped in these valve chambers, which are closed at one end by the cover plate 16.

OPERATION OF FIGS. 1–7

The pump 3 runs submerged, with the housing 1 filled with oil or other liquid being pumped. The pump rotors 22 and 23 draw in liquid at the locality where the rotor teeth separate and discharge liquid from the locality where the teeth are forced together. When shaft 4 is rotating in a clockwise direction, as viewed in FIG. 3, liquid is drawn into the pump through the inlet passage 16*a* in the cover plate and passes through passages 15*a*, bypassing valve 24 through a groove 31 in the side of its valve chamber, and thence through the passage 14*a* to the locality of the pump where the rotor teeth are separating. The liquid is carried around by the rotor teeth to the locality where the teeth are engaging, whence the fluid is discharged through the passages 14*b* and 15*b* and against the valve disc 25 (the right-hand side as viewed in FIG. 8). The valve 25 is thereby forced to its dotted line position against the cover plate 16, closing the inlet port 16*b*. The passage 15*b* communicates through a groove 32 (FIGS. 4, 5 and 8) in the back of the valve plate 15 with the passage 15*f*. The liquid under pressure acts against the bottom of the valve disc 27, as viewed in FIG. 7, and forces it open, so that the liquid flows into the conduit 33 and thence into a connected manifold 34 (FIG. 4) which branches into discharge conduits 34*a* and 34*b*. Conduit 34*a* is in communication through passages 15*c*, 14*c* and 13*a* with the discharge passage 21*a* in the base plate 12. Conduit 34*b* communicates with passages 15*d* and 14*d*, but flow therethrough is blocked by the pump plate 13.

Alternatively, the pump plate may be rotated 180° about a vertical axis so as to align the passage 13*a* with passages 14*d* and 21*b*. The base plate 12 is provided with the two discharge passages 21*a*, 21*b*, in order that it may deliver liquid selectively to either of two receiving port locations in the housing 1. Any particular housing 1 has only one receiving port which may be aligned with either passage 21*a* or 21*b*. Thus, the pump may be assembled to conform to the locations of the receiving port in the housing. Since the pump is intended to be suitable for replacement use, and the housing may be a re-used part, it is desirable that the pump be adaptable to either location of the receiving port.

When the shaft 4 is rotating counterclockwise, as viewed in FIG. 3, liquid enters through the passage 16*b*, (FIGS. 3 and 8), and the valve 25 is forced to the right to the full line position shown in FIG. 8, so that the valve is bypassed through a groove 35 in the plate 15. The liquid flows through the passage 14*b* into the locality between the pump rotors where the gear teeth are separating and then moves around with the gears and is discharged through the passage 14*a* where the gear teeth are engaging. The liquid under pressure discharged at this point flows into passage 15*a*, moving the valve 24 to close the inlet port 16*a*. The liquid then flows through the passage 36 and thence under the valve 26, lifting that valve as viewed in FIG. 7, and thence through passage 33 and the discharge manifold 34 to the branch discharge passages 34*a* and 34*b*, as in the case when the shaft rotation was in the opposite direction.

FIGS. 9–17

These figures illustrate a modified form of replacement pump embodying the invention, which may be inserted in the same housing as that employed with the pump of FIGS. 1–8. The parts of the housing are illustrated in FIG. 9 and have been given the same reference numerals.

Figure 9:
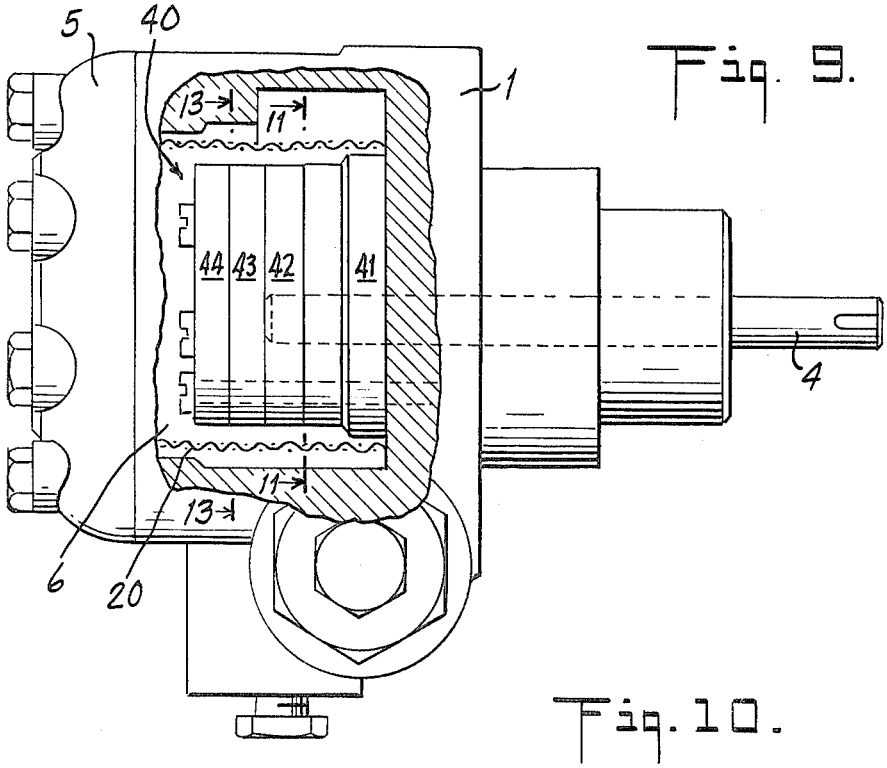
FIG. 9 is a view, partly in elevation and partly in a section similar to FIG. 1, showing a modified form of pump.

The pump assembly is illustrated at 40 in FIG. 9, and is shown in detail in FIGS. 10–17.

Figure 12:
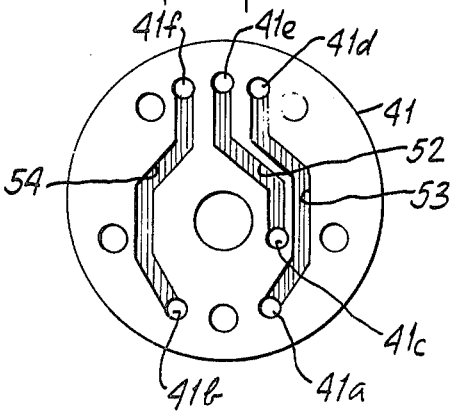
FIG. 12 is a view of the base plate of FIG. 11, taken from the opposite side.

The pump assembly 40 includes a base plate 41, a pump plate 42, a valve plate 43 and a cover plate 44. The base plate 41 includes five holes for the insertion of mounting screws, two discharge ports 41*a*, 41*b* disposed at either side of the lower mounting hole, as shown in FIG. 12, an aperture to receive the shaft 4, and four passages 41*c*, 41*d*, 41*e* and 41*f*. The pump plate 42 encircles a gear pump comprising a ring gear 45 and a pinion gear 46. The pump plate 42 is annular and includes axially extending passages 42*d* and 42*e* respectively aligned with the correspondingly lettered passages in the base plate 41.

The valve plate 43 includes axially extending passages 43*c*, 43*d*, 43*e*, 43*f* and 43*g*. The gear side of the valve plate 43 carries a crescent 47 which extends between the ring gear 45 and the pinion 46. A groove 50 is cut in the outer face of the valve plate 43, and connects the passages 43*e* and 43*g*. On the reverse side of the plate 43, an arcuate passage 51 (FIG. 14) connects the passages 43*d*, 43*e* and 43*f*. On the reverse side of the base plate 41 (FIG. 12), a groove 52 connects passages 41*c* and 41*e*. The two discharge ports 41*a*, 41*b* are connected through grooves 53 and 54 to the passages 41*d* and 41*f*, respectively.

The cover plate 44 has axially extending inlet ports 44*a* and 44*b*.

The passages 43*c*, 43*e* and 43*g* are stepped, each having a wide diameter section separated from a narrow diameter section by a shoulder part way through the passage. The shoulder in passage 43*e* serves as a seat for a disc valve 55 (FIGS. 15 and 17). A shoulder in the passage 43*g* (FIG. 17) faces in the opposite direction and serves as a seat for a disc valve 56. A similar shoulder in the passage 43*c* (FIG. 16) serves as a seat for a disc valve 57, facing in the same directon as the seat for valve 56 (FIG. 17).

OPERATION OF FIGS. 9–17

Figure 10:
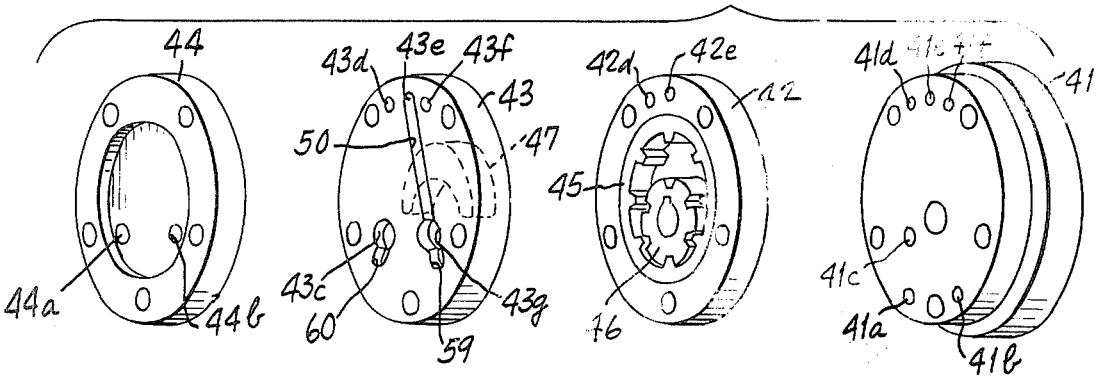
FIG. 10 is an exploded perspective view similar to FIG. 3, but showing the pump of FIG. 9.
Figure 11:
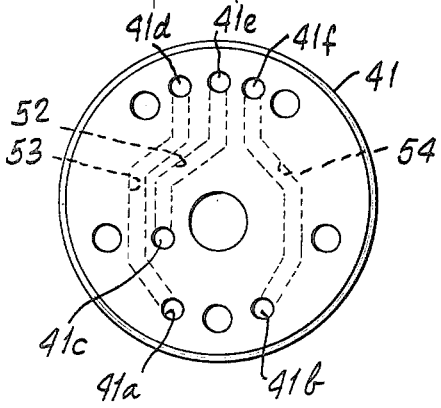
FIG. 11 is a view of the base plate taken on the line 11—11 of FIG. 9.

When the pump is rotating in a clockwise direction as viewed in FIG. 10, liquid is drawn into the pump from the chamber 6 through the inlet port 44*a* and passage 43*c* (FIG. 16), bypassing the valve 57 by means of a groove 60 which extends along one side of the passage 43*c*. The liquid enters the space between the pinion 46 and gear 45 at a locality where the gear teeth are separating, and is carried around with those gears until they reach a locality where the teeth are moving together so that the space is decreasing. The liquid is there discharged through the passage 43*g* (FIG. 17), where it lifts the valve 56 from the position shown in FIG. 17 to the dotted line position where it blocks the inlet port 44*b*. The liquid then flows through the groove 50 into the passage 43*e*. The liquid is there effective to move the valve 55 to the dotted line position shown in FIG. 17, blocking the passage 42*e*. The liquid flows from the passage 43*e* through the arcuate passage 51 (FIGS. 13 and 14) to either one of the passages 43*d* and 43*f*. When the pump plate 42 is assembled in the orientation shown in FIG. 10, the liquid flows through passage 43*d* and thence through passages 42*d* and 41*d*, groove 53 and discharge port 41*a* to the receiving port of the housing 1.

The housing 1 typically has only one receiving port, which may be aligned with either discharge port 41*a* or 41*b*. If the receiving port is aligned with discharge port 41*b*, then pump plate 42 is rotated during assembly on its vertical axis to align passage 42*d* with passages 43*f* and 41*f*. The flow is then through passages 43*f*, 42*d* and 41*f* to groove 54 and discharge port 41*b*.

If the pump gears 45 and 46 are rotating in the counterclockwise directon, then liquid is drawn in through the inlet port 44*b* and enters passage 43*g*, bypassing the valve 56 through the open slot 59 (FIG. 17) and entering the locality between the gears where the space between the teeth is expanding. The liquid is carried around with the gears until it gets to the other side where the teeth are being forced together. The liquid under the pressure developed by the pump acts through passage 43*c* (FIG. 16) against valve 57, moving the valve to the dotted line position and closing inlet port 44*a*. The liquid is discharged from the pump rotors through the passage 41*c* (FIGS. 10–12) groove 52 and passage 41*e* in base plate 41, and thence through passage 42*e* to the passage 43*e* , where it is effective to move the valve 55 to the closed position shown in solid lines in FIG. 17, so that the path of flow into the groove 50 is blocked. The liquid then flows through the arcuate passage 51 to one of the discharge passages 43*d* and 43*f*, and thence along one of the paths previously traced to the delivery port.

FIGS. 18–22

The pump shown in these figures is, like the previous modifications, intended for insertion in the same pump casing 1 shown in FIG. 1. In FIG. 18, the parts which correspond to their counterparts in FIG. 1 have been given the same reference numerals. The pump assembly in FIG. 18 is shown at 61 and comprises a base plate 62, a pump plate 63 and a cover plate 64. In the pump 61, all of the fluid passages and a single valve 65 which controls the direction of the liquid flow are located in the base plate 62. The pump plate 63 encircles a ring gear 66 and a pinion gear 67 of a crescent pump. The cover plate 64 closes the outer side of the pump plate 63, and carries a crescent 64*a* which fills the space between the gears 66 and 67. The inlet to the pump 61 is through a port 62*a* formed as a groove in one side of the base plate 62. The passage 62*a* connects with a connected series of tortuous passages and grooves in the base plate 62, including an axial passage 70, a groove 71 in the bottom face of the plate 62, an axial passage 83, a groove 62*d*, 62*e* cut in the outer face of the base plate 62 and separated by a shoulder midway of its length, into a wider passage section 62*d* and a narrow passage section 62*e* below the shoulder. Most of the narrow section 62*e* is continuously covered by the crescent 64*a* when the pump is operating. The ends of the narrow section 62*e*, which serve as an inlet port for the pump rotor means, are alternately covered and uncovered by the gear teeth. In this pump, the liquid enters the spaces between the gear teeth from the passage section 62*e* at the point of widest separation of the gears, rather than at the locality where the gear teeth are separating, as in previous modifications. The rotation of the pump rotors 66, 67 forces fluid out through one of two ports 62*b* or 62*c*, depending upon the direction of rotaton of the pump.

The ports 62*b* and 62*c* communicate with axial passages 72 and 73, respectively. Passage 72 communicates with a groove 74 on the back side of the plate 62 which in turn communicates with the axial passage 73. The axial passage 73 is best seen in FIG. 22, and includes a shoulder 73*a* midway of its length, separating the narrow section 73*b* from a wide section 73*c*. An annular insert 75 is press fitted in the wide section 73*c* and has a slot 75*a* cut in one side thereof and communicating with the groove 74. The insert 75 has a central axial aperture 75*b*. The valve 65 is trapped between the shoulder 73*a* and the insert 75. When the valve 65 is against the shoulder 73*a*, as shown in full lines in FIG. 22, the narrow section 73*b* of the passage 73 is closed and the flow from the pump is from groove 74 through slot 75*a*, aperture 75*b* and wide passage section 73*a* into an outlet passage 76 which is forked and delivers liquid to either of grooves 76*a* and 76*b*. Groove 76*a* leads through axial passage 77*a*, and groove 78*a* to axial passage 79*a*. Similarly, groove 76*b* leads through axial passage 77*b* and groove 78*b* to axial passage 79*b*. Only one of the passages 79*a*, 79*b* communicates with the receiving port formed in any particular housing 1. The other passage is blocked at the mounting pad. The pump structure shown is adapted for insertion in pump housings 1 which may have their receiving ports in either of two locations.

OPERATION OF FIGS. 18–22

When the pump rotates clockwise as viewed in FIG. 19, liquid flows through inlet port 62*a* to groove 62*d*, 62*e* and is driven by the pump rotors through the port 62*b*, axial passage 72, groove 74 and passage 73, where the liquid pressure is effective to seat the valve 65 against the shoulder 73*a* so that the liquid flows into the outlet passage 76.

When the pump rotates in the counterclockwise direction, the liquid passes through the same inlet conduit as before to the channel 62*e* and then is moved by the pump to the port 62*c*. It then flows into the passage section 73*b*, forcing the valve 65 against the insert 75 and closing the opening 75*b* in that insert so that the liquid enters the outlet passage 76, as before.

The noise of operation of the pump 61 is reduced in the structure shown by the tortuous inlet passages 62*a*, 70, 71, 83, 62*d*, and by the tortuous outlet passages 76*a*, 77*a*, 78*a*, 79*a* and 76*b*, 77*b*, 78*b*, 79*b*. These tortuous passages reduce the transmission of noise through the liquid. Making the teeth of the pump gears 66 and 67 wider than the channel 62*e* also assists in minimizing the noise.

FIGS. 23–27

The pump shown in these figures is, like the previous modifications, intended for insertion in the pump casing shown in FIG. 1. In FIG. 23, the parts which correspond to their counterparts in FIG. 1 have been given the same reference numerals.

The pump assembly in FIG. 23 is shown at 85 and comprises a base plate 86, a pump plate 87, and a cover plate 88. In the pump 85, all of the fluid passages and two valves 96 and 97 which control the directon of the fluid flow are located in the base plate 86. The pump plate 87 encircles a ring gear 89 and a pinion gear 90 of a crescent pump. The cover plate 88 closes the outer side of the pump plate 87, and carries a crescent 88*a* which fills the space between the gears 89 and 90. The inlet port 86*a* to the pump 85 is a groove in one side of the base plate 86. The inlet port 86*a* connects with a series of tortuous passages and grooves in the base plate 86, including an axial passage 91, a groove 92 (FIG. 26) in the bottom face of the plate 86, an axial passage 93, and a groove 86*d*, 86*e* (FIGS. 24 and 25) in the outer face of the base plate. A shoulder separates the wide groove section 86*d* from the narrow groove section 86*e*. Most of the narrow groove section 86*e* is covered by the crescent 88*a*. The ends of the narrow groove section 86*e* are alternately covered and uncovered by the teeth of the rotating gears 89 and 90. The fluid enters the gear teeth from groove section 86*e* at the point of widest separation of the gears, rather than at the locality where the gears are separating, as in more usual pumps. The rotation of the pump rotors 89 and 90 forces fluid out through one of two axial passages 86*b* or 86*c*, depending upon the direction of rotaton of the pump.

Passage 86*b* communicates with a groove 94*a* on the inner face of plate 86 which in turn communicates with an axial passage 95. Passage 95 is a stepped passage having a shoulder 95*a* (FIG. 27) separating the narrow section 95*b* from a wide section 95*c*. The wide section 95*c* communicates with a groove 98. A ball valve 97 is trapped between the shoulder 95*a* and the pump plate 87. A spring 99 is retained between pump plate 87 and ball valve 97. The unstressed length of spring 99 is somewhat shorter than the spacing between plate 87 and ball valve 97 when the valve is seated against should 95*a*. Spring 99 biases the ball valve 97 to a position near shoulder 95*a* so that any liquid movement from groove 98 through passage 95*c* toward groove 94*a* causes ball valve 97 to close against shoulder 95*a* thereby shutting off flow to groove 94*a*. When the flow is reversed by reversing the rotation of gears 89 and 90, air moving from passages 94*a* can open valve 97 without compressing the spring. Since the movement is horizontal, only small friction forces have to be overcome. Once air is purged from the pump, the pressure of the liquid being pumped will compress spring 99, and move ball 97 far enough to cause the liquid to flow to groove 98. Groove 98 communicates with two discharge ports 100*a* and 100*b* one of which communicates with the receiving port formed in the casing 1. Note that groove 98 extends through one of the apertures for receiving a mounting screw 17. The aperture in question is shown at 102 in the drawings. The aperture is sufficiently larger than the screw 17 so that the screw does not appreciably restrict the flow through groove 98.

Passage 86*c* communicates with a valve-controlled flow path similar to that just described in connection with passage 86*b*, but not shown in as great detail in the drawing. The flow path from passage 86*c* may be traced through a groove 94*b*, a passage 101 corresponding in structure and function to passage 95, a valve in that passage and groove 98 to the discharge ports 100*a* and 100b. Valve 96 corresponds in structure and function to valve 97, and is similarly biased by a spring.

OPERATION OF FIGS. 23–27

When the pump rotates clockwise as viewed in FIG. 24, liquid is pumped through inlet 86*a* to the groove 86*d*, 86*e* and is driven by the pump rotors through the axial passage 86*b*, groove 94*a* and passage 95, where the liquid pressure is effective to move valve ball 97 off shoulder 95*a* so that luquid passes into groove 98. Flow is then from groove 98 into passages 100*a* and 100*b* (one of which is aligned with the receiving port in casing 1) and into passage 101 where the liquid pressure is effective to move ball valve 96 against its seat.

When the pump rotates in the counterclockwise direction, the fluid passes through the same inlet route as before. Liquid is then pumped by the gears through passage 86*c* and groove 94*b* to passage 101 where liquid pressure is effective to move ball valve 96 off its seat and thereby to allow flow to groove 98. Flow is then from groove 98 through passage 100*a* or 100*b* to the receiving port in casing 1. Liquid also flows from groove 98 into passage 95*c* where the liquid pressure is effective to move ball valve 97 against the shoulder 95*a* blocking flow to groove 94*a*.

The noise of operation of the pump 85 is reduced in the structure shown by the tortuous inlet passages 86*a*, 91, 92, 93, 86*d*, 86*e*. These tortuous passages reduce the transmission of noise through the fluid. The teeth of the pump gears 89 and 90 are wider than the groove 86*e* which also assists in minimizing the noise.

The pumps illustrated are shown with two discharge ports, so that any such pump may be used with a pump housing having an oil receiving port at either of two locations. Commonly, a mounting pad in a pump housing has its receiving port located with respect to the drive shaft in either a right-hand or a symmetrical left-hand location. The discharge outlets in the pumps illustrated have been located with such conventional mounting pads in view. However, if more than two possible locations of the delivery passage may be encountered in a particular situation, additional discharge ports may be provided in the pumps. The ones not used are blocked at the mounting pad.

While the pumps illustrated are gear pumps of the crescent type, the invention is readily adaptable to other suitable conventional pumps, such as gear pumps using two externally toothed gears, sliding vane pumps, etc.

While some valves are illustrated as disc valves and others as ball valves, either type of valve could be used for any of the illustrated valves. Furthermore, other types of valve, e.g., reed valves, might be used.

I claim:

1. Rotary pump apparatus adapted to be driven in either direction of rotation and to deliver liquid from the same delivery port for either direction of rotation, comprising:

a. a housing including a mounting pad having a receiving port therein communicating with the delivery port;

b. a drive shaft journaled in the housing and projecting through the mounting pad;

c. a plurality of plates stacked against the mounting pad, said plurality of plates including:

1. a base plate adapted to engage the mounting pad, apertured to receive the shaft and having a discharge port aligned with the receiving port on the mounting pad;
2. a pump plate apertured to receive the shaft; and
3. a cover plate;

d. pump rotor means enclosed by the pump plate and adapted to be driven by the shaft, and effective to discharge liquid selectively at one of two points, depending on the direction of rotation of the rotor means;

e. first and second passages extending from said two points to the discharge port in the base plate; and f. valve means in one of said plates and controlling said passages in response to the pressure of the liquid discharged by the pump and effective to open the passage from either selected discharge point to the discharge port and to close the passage between the other discharge point and the discharge port, said valve means comprising a cylindrical chamber defined by a recess in a face of one plate, a disk valve trapped in the chamber and movable therin, a lateral opening in a side of the recess, and an opening in one end of the recess and closeable by engagement of the valve with said end.

2. Rotary pump apparatus as in claim 1, in which the open end of the recess is closed by another of the plates.

3. Rotary pump apparatus as in claim 1, including an inserted piece in the open end of the recess, at least partially closing the recess and keeping the valve trapped therein.

4. Rotary pump apparatus adapted to be driven in either direction of rotation and to deliver liquid from the same delivery port for either direction of rotation, comprising:

a. a housing including a mounting pad having a receiving port therein communicating with the delivery port;

b. a drive shaft journaled in the housing and projecting through the mounting pad;

c. a plurality of plates stacked against the mounting pad, said plurality of plates including:

1. a base plate adapted to engage the mounting pad, apertured to receive the shaft and having a discharge port aligned with the receiving port on the mounting pad;
2. a pump plate apertured to receive the shaft; and
3. a cover plate;

d. pump rotor means enclosed by the pump plate and adapted to be driven by the shaft, and effective to discharge liquid selectively at one of two points, depending on the direction of rotation of the rotor means;

e. first and second passages extending from said two points to the discharge port in the base plate; and f. valve means in one of said plates and controlling said passages in response to the pressure of the liquid discharged by the pump and effective to open the passage from either selected discharge point to the discharge port and to close the passage between the other discharge point and the discharge port, said valve means comprising:

1. a cylindrical chamber defined by a recess in a face of one plate and at least partially closed by the face of an adjacent plate;
2. a lateral opening in a side of the recess;
3. an opening in one end of the recess; and
4. a disk valve in the chamber movable between a closed position in which it is seated on said one end of the recess and closes the opening therein and an open position in which the openings are in fluid communication.

5. Rotary pump apparatus adapted to be driven in either direction of rotation and to deliver liquid from the same delivery port for either direction of rotation, comprising:

a. a housing including a mounting pad having a receiving port therein communicating with the delivery port;

b. a drive shaft journaled in the housing and projecting through the mounting pad;

c. a plurality of plates stacked against the mounting pad, said plurality of plates including:

1. a base plate adapted to engage the mounting pad, apertured to receive the shaft and having a discharge port aligned with the receiving port on the mounting pad;
2. a pump plate apertured to receive the shaft; and
3. a cover plate;

d. pump rotor means enclosed by the pump plate and adapted to be driven by the shaft, and effective to discharge liquid selectively at one of two points, depending on the direction of rotation of the rotor means;

e. first and second passages extending from said two points to the discharge port in the base plate; and f. valve means in one of said plates and controlling said passages in response to the pressure of the liquid discharged by the pump and effective to open the passage from either selected discharge point to the discharge port and to close the passage between the other discharge point and the discharge port, said valve means comprising:

1. a cylindrical chamber in one of said stacked plates;
2. a first opening in a side wall of said chamber;
3. a second opening in an end wall of the chamber, said second opening being smaller than the end wall so that the end wall defines a shoulder around the opening; and
4. a disk valve slidable in the chamber and movable in response to the pressures acting on its opposite sides between a closed position seated against the shoulder and closing the second opening and an open position in which said first and second openings are in fluid communication.

6. Rotary pump apparatus as in claim 5, in which:

a. said valve means includes, in each of said passages:

1. a cylindrical chamber in one of said stacked plates;
2. a first opening in a side wall of said chamber;
3. a second opening in an end wall of the chamber, said second passage being smaller than the end wall so that the end wall defines a shoulder around the passage;
4. a disk valve slidable in the chamber and movable in response to the pressures acting on its opposite sides between a closed position seated against the shoulder and closing the second opening and an open position in which said first and second openings are in fluid communication; and b. said passages include:

1. a conduit extending between said first openings of both said valves and said discharge port; and
2. conduits extending between said second openings and the respective discharge points.

7. Rotary pump apparatus as in claim 5, in which said valve means further comprises:

a. a third opening in the end wall of said chamber opposite said second opening, said third opening being smaller than said opposite end wall so that said opposite end wall defines a shoulder around the opening; and b. said first and third openings are in fluid communication when said valve is in said closed position.

8. Rotary pump apparatus as in claim 5, in which:

a. said plurality of plates consists of the base plate, the pump plate, and the cover plate; and b. said passages and said valve means are located in the base plate.

9. Rotary pump apparatus as in claim 8, in which:

a. said base plate has a valve chamber defined therein by a recess in one face thereof and an insert in the open end of the recess;

b. said valve means comprises a single disk valve trapped between the closed end of the recess and the insert;

c. an outlet for the valve in the side of the valve chamber; and d. inlets opening into the chamber through the insert and the closed end of the recess and selectively closed by said valve.

10. Rotary pump apparatus as in claim 8, in which said base plate has formed therein an inlet passage extending from the periphery of the base plate to an inlet port adjacent the pump rotor.

11. Rotary pump apparatus as in claim 10, in which said inlet passage is tortuous and is effective to damp sound waves.

12. Rotary pump apparatus adapted to be driven in either direction of rotation and to deliver liquid from the same delivery port for either direction of rotation, comprising:

a. a housing including a mounting pad having a receiving port therein communicating with the delivery port;

b. a drive shaft journaled in the housing and projecting through the mountin pad;

c. a plurality of plates stacked against the mounting pad, said plurality of plates including:

1. a base plate adapted to engage the mounting pad, apertured to receive the shaft and having a discharge port aligned with the receiving port on the mounting pad;

2. a pump plate apertured to receive the shaft; and 3. a cover plate;

d. pump rotor means enclosed by the pump plate and adapted to be driven by the shaft, and effective to discharge liquid selectively at one of two points, depending on the direction of rotation of the rotor means;

e. first and second passages extending from said two points to the discharge port in the base plate; and f. valve means in one of said plates and controlling said passages in response to the pressure of the liquid discharged by the pump and effective to open the passage from either selected discharge point to the discharge port and to close the passage between the other discharge point and the discharge port;

g. inlet connections communicating with said two points, the pump being effective to draw liquid through the point not acting as a discharge point and its associated inlet connection; and h. said valve means includes inlet valve means in each inlet connection, each inlet valve means comprising:

1. a cylindrical chamber in one of said stacked plates;

2. a first opening in a side wall of said chamber;

3. a second opening in an end wall of the chamber, said second opening being smaller than the end wall so that the end wall defines a shoulder around the opening; and 4. a disk valve slidable in the chamber and movable in response to the pressures acting on its opposite sides between a closed position seated against the shoulder and closing the second opening and an open position in which said first and second openings are in fluid communication.

* * * * *